US012605583B1

(12) United States Patent
Fu

(10) Patent No.: US 12,605,583 B1
(45) Date of Patent: Apr. 21, 2026

(54) WEIGHT-ADJUSTABLE DUMBBELL APPARATUS

(71) Applicant: Zhejiang Tingjing Intelligent Technology Co., Ltd, Jinhua (CN)

(72) Inventor: Changsheng Fu, Jinhua (CN)

(73) Assignee: Zhejiang Tingjing Intelligent Technology Co., Ltd., Jinhua (CN)

( * ) Notice: Subject to any disclaimer, the term of this patent is extended or adjusted under 35 U.S.C. 154(b) by 0 days.

(21) Appl. No.: 19/343,825

(22) Filed: Sep. 29, 2025

(30) Foreign Application Priority Data

Jul. 21, 2025 (CN) ..... 202521534179.9

(51) Int. Cl.
*A63B 21/075* (2006.01)
*A63B 21/00* (2006.01)
*A63B 21/072* (2006.01)

(52) U.S. Cl.
CPC ..... *A63B 21/075* (2013.01); *A63B 21/0726* (2013.01); *A63B 21/0728* (2013.01); *A63B 21/4035* (2015.10)

(58) Field of Classification Search
CPC ..... A63B 21/4035; A63B 21/072; A63B 21/0722; A63B 21/0724; A63B 21/0728; A63B 21/075; A63B 21/0726
See application file for complete search history.

(56) References Cited

U.S. PATENT DOCUMENTS

| | | | | |
|---|---|---|---|---|
| 5,411,460 | A * | 5/1995 | Karlson | A63B 21/00072 601/118 |
| 6,099,443 | A * | 8/2000 | Landfair | A63B 21/072 482/107 |
| 7,261,678 | B2 * | 8/2007 | Crawford | A63B 71/0054 482/94 |
| 12,397,188 | B1 * | 8/2025 | Wang | A63B 21/0728 |
| 2025/0073522 | A1 * | 3/2025 | Rudd | A63B 21/0726 |
| 2025/0135261 | A1 * | 5/2025 | Cheng | A63B 71/0036 |
| 2025/0242190 | A1 * | 7/2025 | Collner | A63B 21/075 |
| 2025/0332465 | A1 * | 10/2025 | Jiang | A63B 21/0726 |
| 2025/0375652 | A1 * | 12/2025 | Jiang | A63B 21/0726 |

* cited by examiner

*Primary Examiner* — Megan Anderson
*Assistant Examiner* — Jonathan A Dicuia
(74) *Attorney, Agent, or Firm* — PV IP PC; Peter Stecher

(57) ABSTRACT

A weight-adjustable dumbbell apparatus is disclosed, comprising a handle, a primary dumbbell plate, and one or more secondary dumbbell plates. A connection assembly rotationally couples adjacent plates. The assembly features a protrusion member extending from a first plate that engages a locking plate within a receiving recess on a second plate. Relative rotation between the plates creates a mechanical interference that prevents their axial separation. The apparatus further includes a detent mechanism, having a spring-biased detent ball, which provides tactile feedback upon locking. Complementary fan-shaped surfaces are provided on the protrusion member and receiving recess to guide the rotational motion. The dumbbell plates have a composite construction, and a connecting rod of the handle threadedly connected to a weight core within the primary dumbbell plate to form a rigid base unit. The design provides a rapid and secure weight adjustment solution.

19 Claims, 5 Drawing Sheets

WEIGHT-ADJUSTABLE DUMBBELL APPARATUS

CROSS-REFERENCE TO RELATED APPLICATION

This application claims priority to Chinese Patent Application No. 2025215341799, filed on Jul. 21, 2025. The disclosure of which is herein incorporated by reference in its entirety.

TECHNICAL FIELD

The present disclosure relates generally to the field of exercise and fitness equipment. More specifically, the present disclosure relates to a weight-adjustable dumbbell apparatus.

BACKGROUND

Physical fitness and strength training are integral and indispensable components of a healthy lifestyle and athletic performance enhancement. Among the vast array of exercise equipment available, free weights, such as dumbbells and barbells, remain a cornerstone of effective resistance training due to their unmatched versatility in promoting functional strength, muscle hypertrophy, and neuromuscular coordination. Dumbbells, in particular, are prized for their ability to allow for unilateral movements, thereby addressing strength imbalances and engaging a greater number of stabilizer muscles compared to fixed-machine exercises. They are fundamental tools for a virtually limitless range of exercises targeting all major and minor muscle groups.

The cornerstone principle of effective strength training is progressive overload, which necessitates the gradual and systematic increase of resistance over time to continually stimulate physiological adaptations. To accommodate this principle, a user requires access to a wide spectrum of weights. In a commercial gym setting, this is typically achieved by providing a large rack of dozens of pairs of fixed-weight dumbbells, often ranging from 5 pounds to over 100 pounds in 2.5 or 5-pound increments. While functionally ideal, this solution is wholly impractical for home or personal use due to prohibitive costs, substantial spatial requirements for storage, and a complete lack of portability.

To address these limitations, adjustable dumbbells were developed. The earliest and still most common designs involve a handle with threaded ends (spin-lock dumbbells). Weight plates are slid onto these ends and secured by a threaded collar. This design, while simple, is fraught with significant drawbacks. The process of changing weights is notoriously slow, tedious, and labor-intensive, requiring the user to unscrew, swap plates, and re-tighten collars on both ends of the dumbbell. This cumbersome procedure severely disrupts workout pacing, rendering advanced training techniques like drop sets, supersets, or pyramid sets inefficient and frustrating. More critically, the threaded collars have a well-documented propensity to loosen during dynamic exercises due to vibrations and rotational forces, posing a significant safety hazard from potentially dislodged plates. This necessitates frequent, workout-interrupting checks to re-tighten the collars.

A more modern approach is the "selectorized" dumbbell. These systems typically feature a cradle containing a nested set of weight plates, and a selector mechanism (e.g., a dial or a pin) allows the user to engage a desired number of plates. While offering rapid weight changes, these systems introduce their own set of problems. They are mechanically complex, often incorporating numerous small, load-bearing moving parts, springs, and latches, which increases the potential points of failure and reduces long-term durability. A misalignment or failure of the selector pin can lead to catastrophic failure during a lift. Furthermore, selectorized dumbbells are often bulky, maintaining a large, fixed form factor regardless of the weight selected, which can impede the user's range of motion in certain exercises (e.g., dumbbell presses or overhead triceps extensions). Their high cost also places them out of reach for many fitness enthusiasts.

Therefore, a significant and unmet need persists in the art for an improved adjustable dumbbell system that synergistically combines the simplicity, robustness, and solid feel of traditional fixed dumbbells with the speed and convenience of selectorized systems, while simultaneously mitigating the safety and usability issues of existing designs. The ideal solution would feature a connection mechanism that is intuitive, extremely fast, unequivocally secure, and highly durable, without reliance on threads or complex internal pin assemblies. The present invention is directed at overcoming these and other deficiencies in the prior art.

SUMMARY

The present disclosure provides a comprehensive and elegant solution to the aforementioned problems by introducing a weight-adjustable dumbbell apparatus featuring an innovative, multi-faceted, and highly efficient rotational locking mechanism. This mechanism, which forms the core of the invention, allows a user to couple and decouple weight plates with a simple, intuitive twisting motion, thereby achieving a paradigm shift in speed, safety, and user confidence for adjustable free weights.

According to a principal embodiment of the present disclosure, a weight-adjustable dumbbell apparatus is provided. The apparatus includes a central handle and at least two sets of dumbbell plates. Each set of plates includes a primary dumbbell plate, which is fixedly and permanently attached to a respective end of the handle to form a solid base unit, and one or more secondary dumbbell plates, which are configured to be removably coupled to the primary plate or to each other. The key inventive feature is at least two connection assemblies disposed between any two adjacent dumbbell plates.

Each of the connection assemblies includes a male engagement feature, referred to herein as a protrusion member, which extends axially from a connecting surface of a first dumbbell plate. It also includes a complementary female engagement feature, a first receiving recess, formed within the connecting surface of a second, adjacent dumbbell plate. A critical component, a locking plate, is disposed within this first receiving recess, while a corresponding first engagement recess is formed on the surface of the protrusion member. The geometry of these components is precisely engineered such that, following an axial insertion of the protrusion member into the receiving recess, a relative rotation between the two plates, preferably through an angle of between 30 and 120 degrees, causes the locking plate and the protrusion member to inter-engage, forming a robust, load-bearing mechanical interference. This interference absolutely prevents any axial separation of the plates. To facilitate the initial insertion and provide clearance for rotation, the overall surface area of the first receiving recess is designed to be greater than that of the protrusion member.

To enhance the security, performance, and user-friendliness of this core mechanism, the connection assembly in various embodiments may further integrate a plurality of additional inventive features. For instance, to provide a more positive and vibration-resistant lock, the locking plate may be provided with a raised feature, and the first engagement recess may have a corresponding indentation, which mate to create a detent in the fully locked position.

To provide unambiguous feedback to the user, the connection assembly may further include a detent mechanism. In a preferred embodiment, this mechanism includes a second receiving recess formed in the protrusion member, which houses a biasing member, such as a metallic coil spring, and a detent ball, which may be included of a hard material such as stainless steel or ceramic. A corresponding second engagement recess is formed in the base of the first receiving recess. As the plates are rotated into the locked position, the spring-biased detent ball snaps into its corresponding recess, producing a distinct audible and tactile "click." To provide an additional layer of confirmation, the apparatus may also be provided with a visual locking indicator.

To ensure a smooth, precise, and wobble-free rotational movement, the sidewall of the first receiving recess may be provided with a plurality of concentric first fan-shaped surfaces, while the periphery of the protrusion member is provided with a plurality of concentric second fan-shaped surfaces configured to mate therewith. These surfaces act as concentric guide rails during rotation. Further refinements may include a limit stop portion on the locking plate and a bearing portion on the protrusion member to define a hard stop at the end of the rotational travel. The connection may be further stabilized by the inclusion of a mating arcuate recessed portion and arcuate protruding portion. A sloped surface may also be integrated within the first receiving recess to contact one end of the protrusion member during unlocking, thereby generating a gentle axial force to assist in plate separation.

The dumbbell plates themselves are preferably of a composite construction, including a durable polymeric outer casing, which may have a polygonal shape to serve as an anti-roll feature; a rigid internal mounting plate that incorporates the features of the connection assembly; and a dense weight core, which may be included of cast iron or steel. The outer casing is provided with an engagement block having a sloped surface, and the mounting plate is provided with a corresponding third engagement recess. An edge of the mounting plate may be provided with an auxiliary notch. For applications requiring extreme load-bearing capacity, the protrusion member or the mounting plate may be manufactured from metal.

The handle includes an ergonomic cylindrical shell, which may be provided with a knurled texture to enhance grip, and a solid connecting rod. The cylindrical shell is connected to the outer casing of the primary plates via a permanent joint, and the connecting rod passes through and threadedly engages the weight core of the primary plates, creating an exceptionally rigid and durable pre-tensioned assembly to serve as the foundational unit for the apparatus.

BRIEF DESCRIPTION OF THE DRAWINGS

To provide a clearer understanding of the technical solutions in the embodiments of the present disclosure or in the prior art, the accompanying drawings that are required for the description of the embodiments or the prior art are briefly introduced below. It is to be understood that the drawings described below are merely some embodiments of the present disclosure. For a person of ordinary skill in the art, other drawings can be obtained based on the structures shown in these drawings without involving an inventive step.

Figure 1:
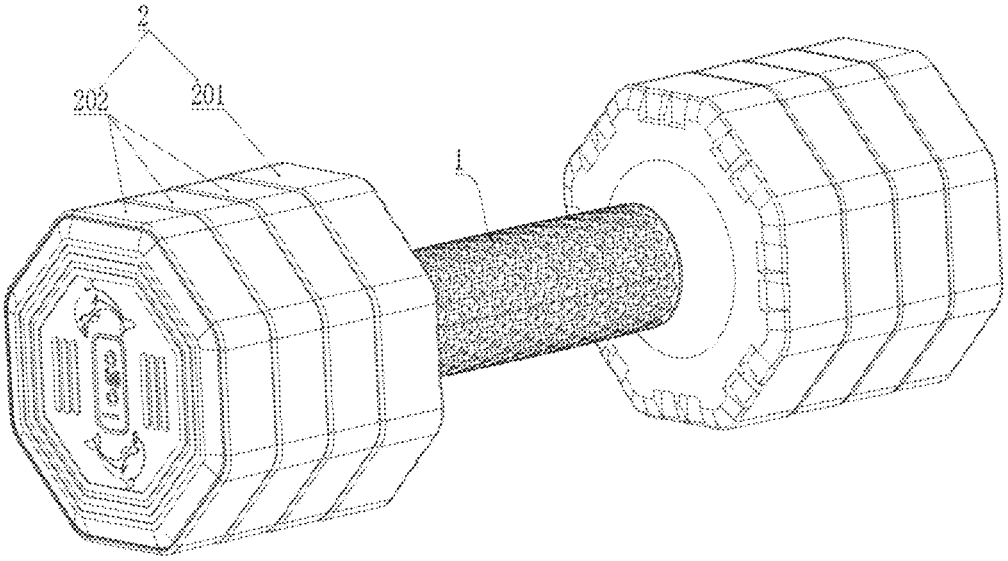
FIG. 1 is a perspective view of a weight-adjustable dumbbell apparatus in a fully assembled state, according to an exemplary embodiment of the present disclosure.

The reference numerals used in the drawings are listed as follows:

1, handle; 2, dumbbell plate; 3, connection assembly; 4, biasing member; 5, detent ball; 101, cylindrical shell; 102, connecting rod; 201, primary dumbbell plate; 202, secondary dumbbell plate; 203, outer casing; 204, mounting plate; 205, weight core; 301, protrusion member; 302, first receiving recess; 303, locking plate; 304, first engagement recess; 2031, engagement block; 2032, sloped surface; 2041, third engagement recess; 2042, auxiliary notch; 3011, second receiving recess; 3012, second fan-shaped surface; 3013, arcuate protruding portion; 3021, first fan-shaped surface; 3022, arcuate recessed portion; 3023, second engagement recess; 3024, sloped surface; 3031, limit stop portion; 3032, raised feature; 3041, bearing portion; 3042, indentation.

The realization of the objectives, functional features, and advantages of the present disclosure will be further described in conjunction with the embodiments and with reference to the accompanying drawings.

DETAILED DESCRIPTION

The technical solutions in the embodiments of the present disclosure will now be described clearly and completely with reference to the accompanying drawings. It is apparent that the described embodiments are only a part of the embodiments of the present disclosure, rather than all of the embodiments. Based on the embodiments in the present disclosure, all other embodiments obtained by a person of ordinary skill in the art without making inventive efforts shall fall within the protection scope of the present disclosure.

It should be noted that all directional indicators in the embodiments of the present disclosure (such as up, down, left, right, front, rear, etc.) are only used to explain the relative positional relationships, motion states, etc., of the components in a specific orientation (as shown in the drawings). If this specific orientation changes, the directional indicators will also change accordingly.

Furthermore, the use of terms such as "first," "second," etc., in the present disclosure is for descriptive purposes only and cannot be understood as indicating or implying relative importance or implicitly indicating the number of technical features indicated. Thus, a feature defined as "first" or "second" may explicitly or implicitly include at least one of the features. Additionally, the technical solutions of the various embodiments may be combined with one another, but this must be based on what can be implemented by a person of ordinary skill in the art. When the combination of technical solutions is contradictory or cannot be realized, it should be considered that such a combination does not exist and is not within the protection scope claimed by the present disclosure.

The following detailed description is of the best currently contemplated modes of carrying out the invention. The description is not to be taken in a limiting sense, but is made merely for the purpose of illustrating the general principles of the invention, since the scope of the invention is best defined by the appended claims.

I. Overall Structure of the Apparatus

Figure 2:
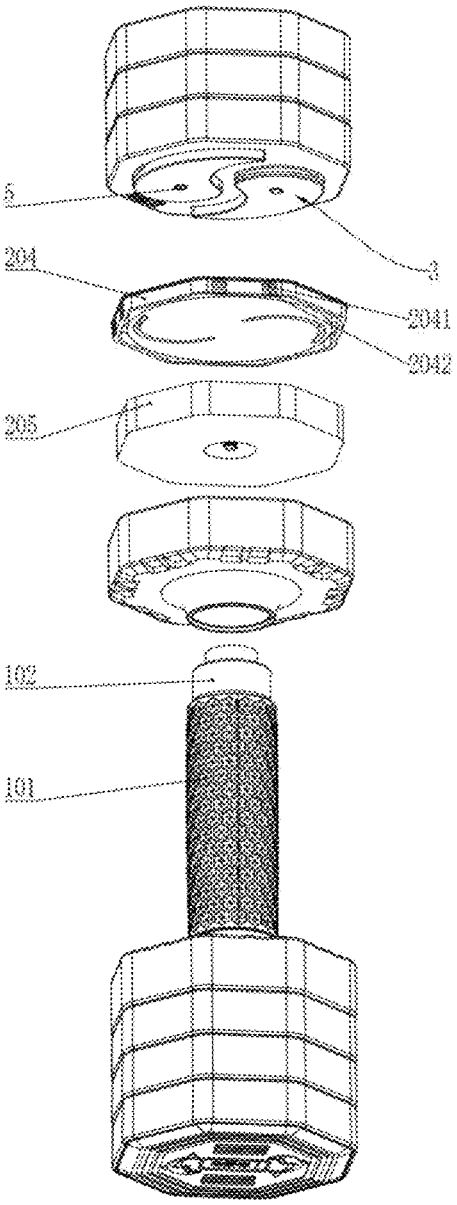
FIG. 2 is an exploded perspective view of the dumbbell apparatus shown in FIG. 1, illustrating the handle, dumbbell plates, and internal components.

Referring first to FIG. 1 and FIG. 2, the weight-adjustable dumbbell apparatus of the present disclosure includes a central handle 1 and two sets of dumbbell plates 2 positioned at opposite ends thereof. Each set of dumbbell plates 2 is composed of a primary dumbbell plate 201 and one or more secondary dumbbell plates 202. Each primary dumbbell plate 201 is fixedly attached to a respective end of the handle 1, forming a solid, non-removable base unit of the dumbbell. The secondary dumbbell plates 202 are configured to be removably and sequentially attached to the primary dumbbell plate 201 or to an already-installed secondary dumbbell plate 202. This modular attachment is enabled by at least two connection assemblies 3, which are disposed between any two adjacent dumbbell plates (e.g., between the primary plate 201 and the first secondary plate 202, or between two adjacent secondary plates 202).

II. The Handle Assembly

The handle 1 serves as the primary user interface and the central structural spine of the apparatus. As best shown in FIG. 2, it includes a cylindrical shell 101 and a connecting rod 102. The cylindrical shell 101 is the portion gripped by the user and can be manufactured from various materials, including, but not limited to, high-strength steel, aircraft-grade aluminum, or a rigid, reinforced polymer composite. Its outer surface is preferably provided with a texture or coating to enhance grip and comfort. This may include traditional diamond-pattern knurling, a soft-touch rubber or neoprene over-mold, or an ergonomic, contoured shape. The connecting rod 102 is the core structural element, typically machined from solid high-tensile steel. The two sides of the cylindrical shell 101 are rigidly connected to the outer casing 203 of each respective primary dumbbell plate 201. This connection constitutes a permanent joint. The connecting rod 102 passes through the central axis of the primary dumbbell plate 201 and is threadedly connected to the weight core 205 housed therein. This threaded engagement, which may be a fine or coarse thread, creates an extremely robust, pre-tensioned assembly, ensuring that the handle and the two innermost plates form a single, inseparable, and rigid unit with no play or rattle.

III. The Dumbbell Plates

Figure 5:
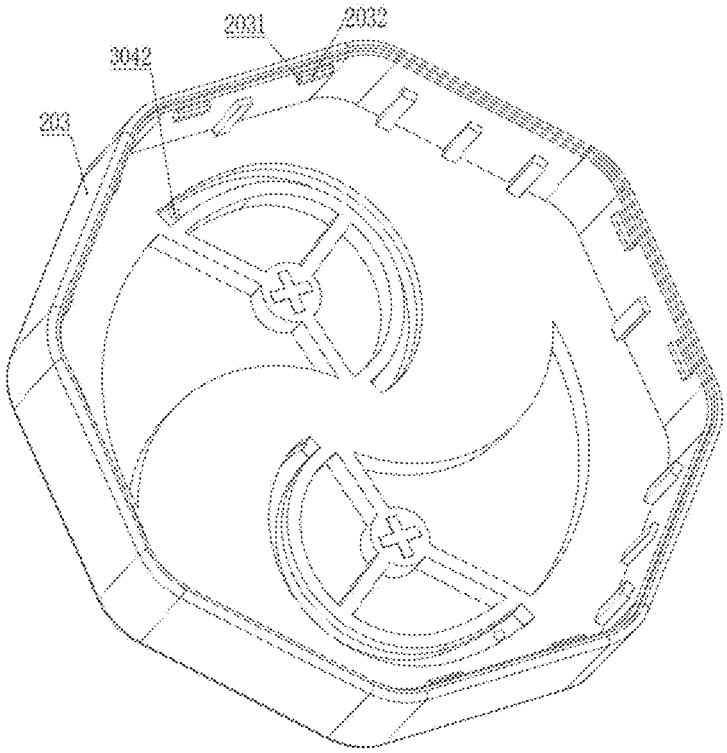
FIG. 5 is a perspective view illustrating the structural details of an outer casing of a dumbbell plate.
Figure 6:
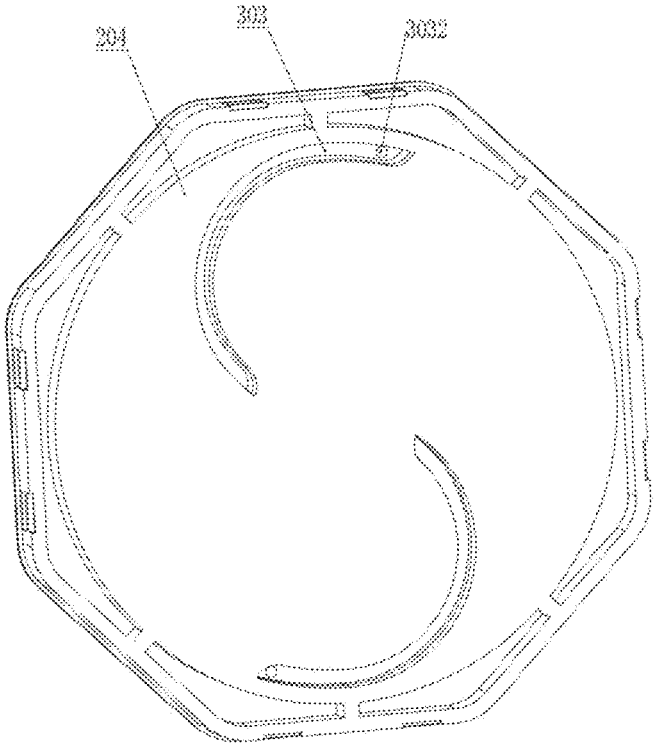
FIG. 6 is another perspective view illustrating the structural details of a mounting plate of a dumbbell plate.

As shown in FIGS. 2, 5, and 6, each dumbbell plate 2 is preferably of a multi-component, composite construction to optimize for durability, cost, and aesthetics. This construction includes an outer casing 203, a mounting plate 204, and a weight core 205.

The outer casing 203 forms the external shell of the plate. It is preferably manufactured from a high-impact and abrasion-resistant polymer, such as Acrylonitrile Butadiene Styrene (ABS), glass-filled nylon, or polypropylene. This polymeric exterior prevents damage to floors and other equipment. The shape may be polygonal, such as the octagonal shape shown, to serve as an anti-roll feature. Internally, the casing is provided with an engagement block 2031, which itself has a sloped surface 2032 to facilitate a snap-fit or interference-fit connection with the mounting plate.

The mounting plate 204 serves as the structural interface and incorporates the precision features of the connection assembly. It is preferably made of a high-strength, dimensionally stable polymer. It is provided with a third engagement recess 2041 that is complementary to the engagement block 2031 of the casing. An auxiliary notch 2042 may be provided on the edge of the mounting plate to aid in alignment during factory assembly.

The weight core 205 provides the majority of the mass for the plate. It is a dense, inert ballast material, such as cast iron, steel, or a high-density metal-polymer composite. It is custom-shaped to fit snugly within the cavity created by the outer casing and mounting plate.

For applications requiring extreme load-bearing capacity or durability, at least one of the protrusion member 301 or the mounting plate 204 may be manufactured from metal, such as forged or CNC-machined aluminum or steel.

IV. The Rotational Connection Assembly

The connection assembly 3 is the heart of the invention, enabling the rapid and secure interchange of plates. Its structure and function will now be described in exhaustive detail.

At least two connection assemblies 3 are disposed between a first one of the adjacent dumbbell plates and a second one of the adjacent dumbbell plates. Each of the at least two connection assemblies includes a protrusion member 301 extending from the first plate and a first receiving recess 302 formed in the second plate.

Figure 3:
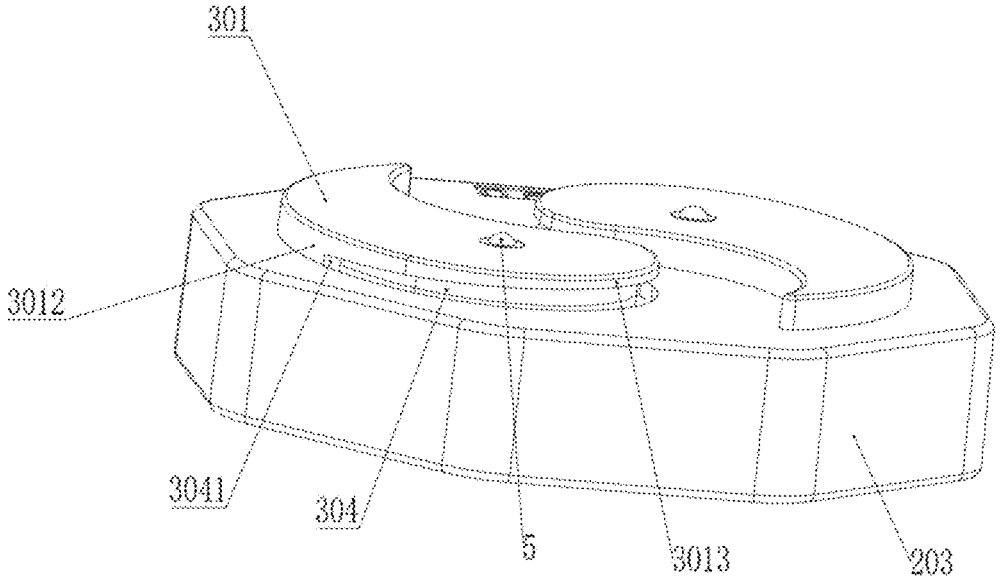
FIG. 3 is a detailed perspective view of a portion of the connection assembly, specifically showing the protrusion member on a dumbbell plate.

The protrusion member 301, shown in FIG. 3, is a precisely formed male engagement feature, which may be integrally molded with the mounting plate 204 or manufactured as a separate component and subsequently affixed thereto. Its material must exhibit high strength and wear resistance.

Figure 4:
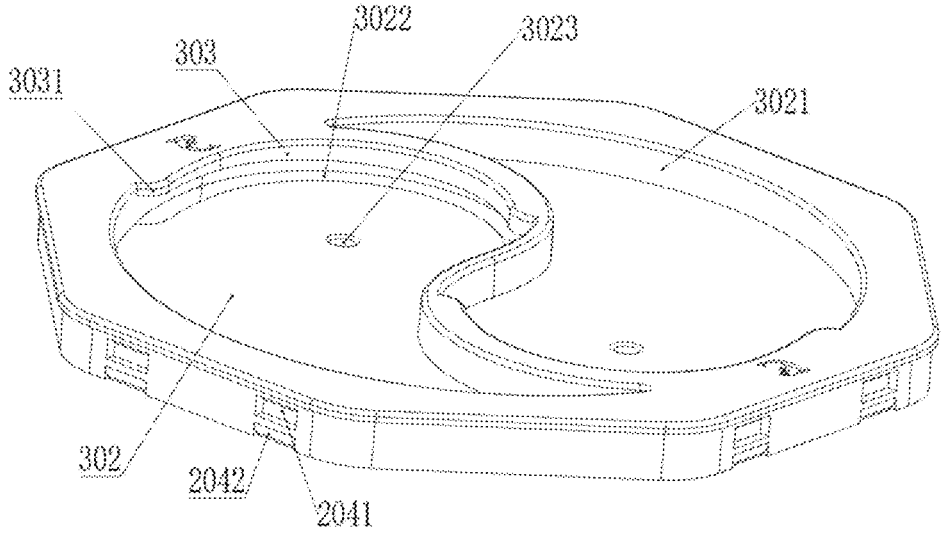
FIG. 4 is a perspective view illustrating the structural details of a mounting plate of a dumbbell plate.

The first receiving recess 302, shown in FIG. 4, is the corresponding female cavity. A key geometric constraint is that the surface area of the first receiving recess is greater than the surface area of the protrusion member. This differential provides the necessary clearance to allow the protrusion member to be inserted axially into the recess without interference, before the rotational engagement begins.

A locking plate 303 is disposed within the first receiving recess 302. This component may be integrally molded with the mounting plate 204 of the second plate. It presents a load-bearing surface that will interfere with the protrusion member in the locked state. A corresponding first engagement recess 304 is formed on the surface of the protrusion member 301.

The operation is as follows: The user aligns the protrusion member 301 with the first receiving recess 302 in an unlocked, insertion orientation. The user then moves the plates together axially. Once fully seated, the user performs a relative rotation between the plates. This rotation moves the solid, load-bearing portions of the locking plate 303 over the solid portions of the protrusion member 301, while simultaneously moving the solid portions of the protrusion member 301 under the locking plate 303. This creates a powerful mechanical interference that prevents any subsequent axial separation.

A. Positive Locking

To provide a more secure lock that actively resists loosening due to in-use vibrations or inertial forces, a positive locking feature may be incorporated. As shown in FIG. 4, the locking plate 303 may be provided with at least one raised feature 3032. This feature can be a small hemispherical bump, a conical point, or a rectangular lug. Correspondingly, the first engagement recess 304 on the protrusion member is provided with a complementary indentation 3042. As the user rotates the plate into the final locked position, the raised feature 3032 snaps into the indentation 3042, creating a positive, physical detent that must be overcome with initial torque to unlock the plate.

B. Detent and Feedback Mechanism

Figure 8:
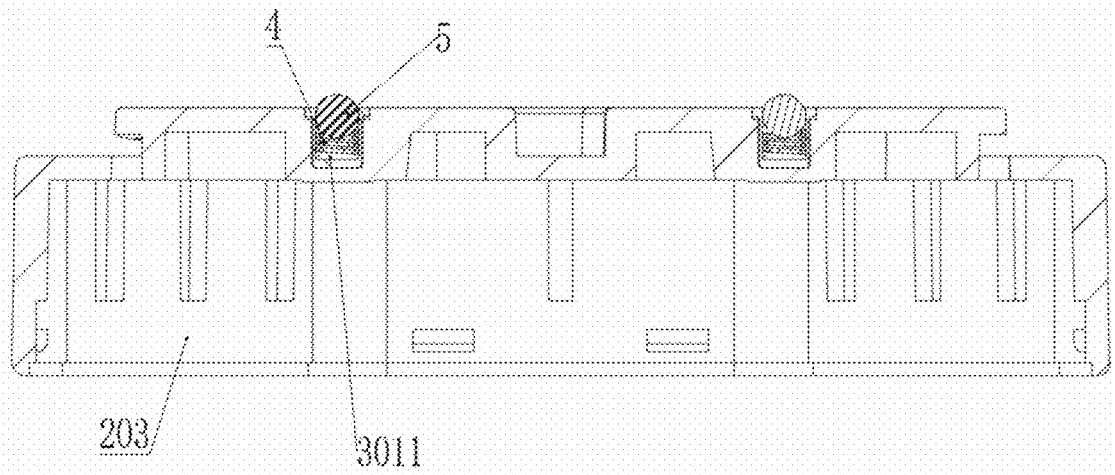
FIG. 8 is a cross-sectional view of a portion of the connection assembly, illustrating the detent mechanism.

To provide the user with unambiguous confirmation of a secure lock, a dedicated detent mechanism is provided, as illustrated in FIG. 8. A second receiving recess 3011, which may be a cylindrical bore, is formed in the protrusion member 301. A biasing member 4 and a detent ball 5 are disposed within this recess. The biasing member 4 is preferably a metallic coil spring, but could alternatively be an elastomeric bumper or a leaf spring. The detent ball 5 is preferably a hard material such as stainless steel or ceramic. A portion of the detent ball 5 protrudes from a surface of the second receiving recess 3011. The biasing member 4 exerts a constant outward force on the detent ball 5. A corresponding second engagement recess 3023, which may be a small conical or spherical depression, is formed in the base of the first receiving recess 302. During rotation to the locked position, the spring-loaded detent ball 5 rolls along the base surface until it aligns with the second engagement recess 3023, at which point it snaps into the recess. This action produces a clearly audible and tactile "click," providing crucial safety feedback to the user when the detent ball engages the second engagement recess.

C. Guide Surfaces

To ensure a smooth, precise, and stable rotational motion without any undesirable wobble or play, complementary guide surfaces are provided. A sidewall of the first receiving recess 302 is provided with a plurality of concentric first fan-shaped surfaces 3021, and the peripheral surface of the protrusion member 301 is provided with plurality of concentric second fan-shaped surfaces 3012. These surfaces are arcuate and concentric with the axis of rotation. During the twisting motion, these surfaces are in sliding contact, acting like guide rails to ensure perfect alignment and distribute rotational forces evenly.

D. Limit Stop

To provide a definitive end-point for the locking rotation and prevent over-torquing or misalignment, a limit stop feature is incorporated. The locking plate 303 is provided with a limit stop portion 3031, which is an abrupt wall or edge. The first engagement recess 304 is provided with a corresponding bearing portion 3041. At the completion of the locking rotation, the limit stop portion 3031 physically abuts the bearing portion 3041, creating a hard stop that defines the fully locked position.

E. Stabilizing Surfaces

To further increase the rigidity of the connection and make the assembled plates feel like a single, solid unit, additional stabilizing surfaces are provided. The first receiving recess 302 is provided with an arcuate recessed portion 3022, and the protrusion member 301 is provided with a corresponding arcuate protruding portion 3013. These features are designed to mate and interlock when the assembly is in the locked position, providing substantial resistance against shear forces and torsional loads.

F. Disassembly-Assisting Structure

Figure 7:
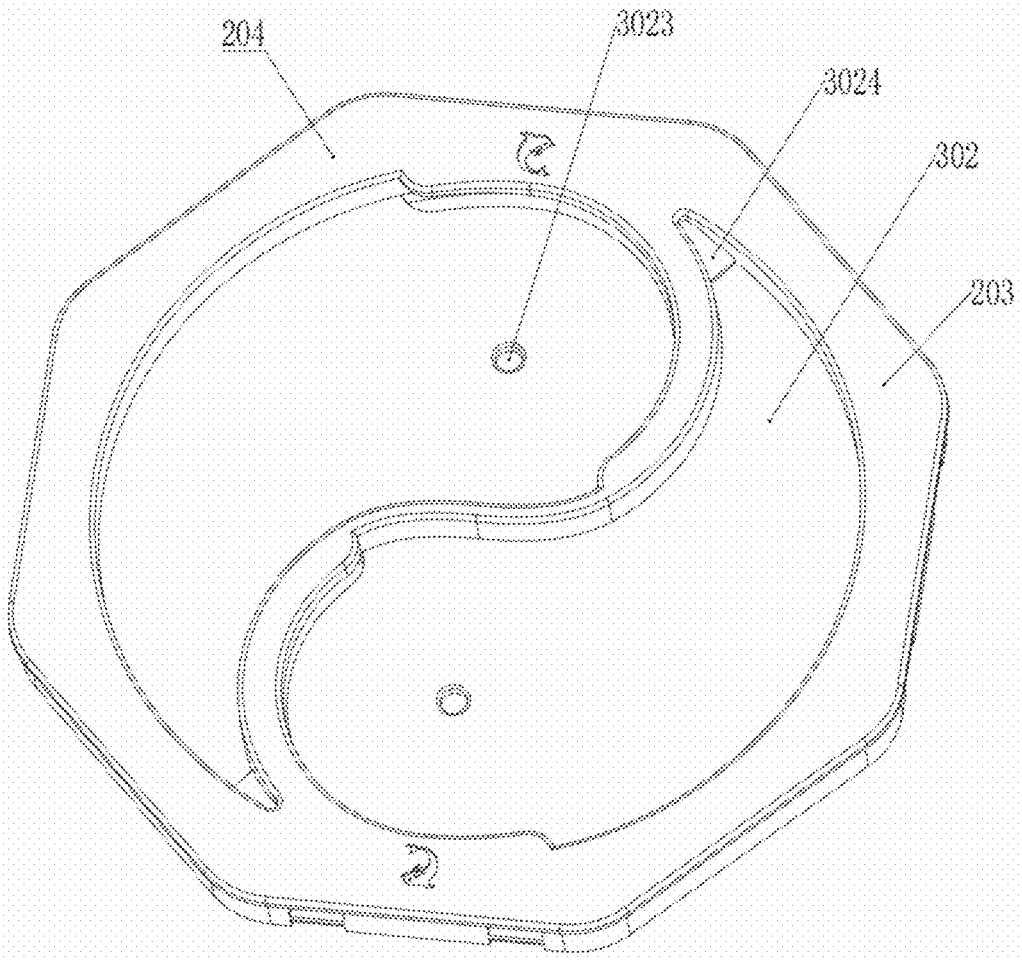
FIG. 7 is another perspective view illustrating the structural details of a mounting plate of a dumbbell plate.

To make the process of removing a weight plate effortless, a disassembly-assisting feature is included. As shown in FIG. 7, a sloped surface 3024, or ramp, is provided within the first receiving recess 302. This ramp is positioned such that, during the unlocking rotation (from the locked position back to the unlocked position), one end of the protrusion member 301 makes contact with and travels up this sloped surface 3024. This interaction converts a component of the rotational force into an axial force, effectively giving the plates a gentle push apart and overcoming any friction or stiction between them.

G. Dumbbell Plate Construction and Integration

The preceding features of the connection assembly 3 are physically realized within the structure of the dumbbell plates 2 themselves. As illustrated in FIGS. 2, 5, and 6, each dumbbell plate 2 is preferably of a multi-component, composite construction to optimize for durability, cost, and aesthetics. This construction includes an outer casing 203, a mounting plate 204, and a weight core 205.

The outer casing 203 forms the external shell of the plate, providing an aesthetic and protective layer. It is preferably manufactured from a high-impact and abrasion-resistant polymer, such as Acrylonitrile Butadiene Styrene (ABS), glass-filled nylon, or polypropylene. This polymeric exterior prevents damage to floors and other equipment and can be molded into various shapes, including polygonal forms (like the octagon shown) which serve as an anti-roll feature. Internally, the casing is provided with one or more engagement blocks 2031. Each engagement block is strategically located and shaped to securely interface with the mounting plate. To facilitate a robust snap-fit or interference-fit connection, each engagement block is provided with a sloped surface 2032.

The mounting plate 204 serves as the primary structural interface and is the component that incorporates the precision features of the connection assembly (such as the first receiving recess 302 or the protrusion member 301). It is preferably made of a high-strength, dimensionally stable polymer capable of withstanding the significant loads experienced during use. The mounting plate is provided with a third engagement recess 2041 that is precisely shaped to be complementary to the engagement block 2031 of the casing. During assembly, the sloped surface 2032 of the engagement block allows it to slide into and securely lock within the third engagement recess, creating a strong, integrated structure. To further aid in factory alignment and assembly, an edge of the mounting plate is provided with an auxiliary notch 2042.

The weight core 205 is a dense, inert ballast material that provides the majority of the mass for the plate. It is typically made from cast iron or steel, but could also be a high-density metal-polymer composite. It is custom-shaped to fit snugly within the cavity created by the assembly of the outer casing 203 and the mounting plate 204.

H. Handle Assembly and Integration with Primary Plate

The foundation of the entire dumbbell apparatus is the rigid assembly of the handle 1 and the two primary dumbbell plates 201. As illustrated in FIG. 2, the handle 1 includes a cylindrical shell 101 and a connecting rod 102.

The cylindrical shell 101 is the portion gripped by the user and can be manufactured from various materials, including high-strength steel or aircraft-grade aluminum. Its outer surface may be knurled or coated to enhance grip. As recited, the two sides of the cylindrical shell are connected to the outer casing 203 of the primary dumbbell plate. This connection can be achieved through welding, a high-strength adhesive bond, or a mechanical interlock, ensuring a solid and permanent joint.

The connecting rod 102 is the core structural element that ties the entire base unit together, typically machined from solid high-tensile steel. In operation, the connecting rod passes through the outer casing 203 of the primary dumbbell plate and is threadedly connected to the weight core 205 within the primary dumbbell plate. This long, continuous threaded engagement creates an exceptionally robust, pre-tensioned assembly. It ensures that the handle and the two innermost plates form a single, inseparable, and rigid unit with absolutely no play or rattle, perfectly mimicking the feel of a high-quality fixed dumbbell and providing the stable foundation upon which the secondary dumbbell plates are loaded.

I. Visual Locking Indicator

To provide an additional layer of safety confirmation beyond the tactile and audible feedback from the detent mechanism, the apparatus may further include a visual locking indicator. This indicator is configured to show a locked state when the relative rotation is complete. This feature may be implemented in various forms, for example, as a colored marker, a symbol (e.g., a green dot or a lock icon), or an alignment line placed on the periphery of the secondary dumbbell plate 202. This marker is strategically positioned to align with a corresponding "LOCKED" symbol or another fiducial mark on the adjacent plate (e.g., 201) only when the assembly is securely in the locked position. This provides the user with an immediate, unambiguous, and at-a-glance visual verification of the lock status, further enhancing safety and user confidence.

J. Angle of Rotation

The operational efficiency of the connection assembly 3 is defined by the extent of the required user input. The relative rotation between an unlocked position and the locked position is through an angle of between 30 and 120 degrees. This range is specifically chosen to balance several key factors. A smaller angle within this range (e.g., 30 to 60 degrees) enhances the speed of weight changes, making the operation extremely rapid. A larger angle within this range (e.g., 60 to 120 degrees) can provide for a longer engagement path for the locking surfaces, which may be desirable in applications requiring exceptionally high load capacity. This defined angular range ensures the mechanism is both quick to use and mechanically robust, avoiding the excessively long rotations of threaded systems and the minimal, potentially less secure rotations of other mechanisms.

V. Method of Operation

The elegant design of the connection assembly 3 translates into an exceptionally simple, rapid, and intuitive method of operation for the user. The process of adding or removing a weight plate can be accomplished in seconds, without the need for tools or significant effort. The following describes the step-by-step method of using the apparatus.

A. Assembling a Secondary Dumbbell Plate

To add weight to the dumbbell, the user performs the following steps:

1. Alignment: The user first takes a secondary dumbbell plate 202 and orients its connecting surface, which contains the first receiving recess 302, toward the connecting surface of the last plate on the stack (e.g., the primary dumbbell plate 201 or another secondary dumbbell plate 202), which features the protrusion member 301. The non-symmetrical, keyed geometry of the protrusion member 301 and the corresponding shape of the locking plate 303 within the recess 302 ensure that insertion is only possible in a single, predetermined rotational orientation—the unlocked position. This intuitive alignment prevents any incorrect assembly attempts.

2. Axial Insertion: Once aligned, the user simply moves the secondary dumbbell plate 202 axially toward the dumbbell assembly. The protrusion member 301 slides smoothly into the first receiving recess 302 until the connecting surfaces of the two adjacent plates are flush against each other. In this fully seated but unlocked position, the solid portions of the protrusion member 301 are aligned with the open areas of the locking plate 303, and vice versa, allowing for unimpeded insertion.

3. Rotational Engagement: From the seated position, the user applies a gentle rotational force to the newly added secondary dumbbell plate 202, twisting it relative to the rest of the dumbbell assembly. This rotation is guided by the interaction of the first fan-shaped surface 3021 and the second fan-shaped surface 3012, ensuring a smooth and precise motion. As the plate rotates toward the locked position, the user may feel a slight increase in resistance as the detent ball 5 rolls along its path. The rotation continues until the limit stop portion 3031 makes contact with the bearing portion 3041, providing a definitive hard stop.

4. Locking Confirmation: The instant the fully locked position is reached, the user receives two forms of unambiguous confirmation. First, the user will hear and feel a distinct "click" as the detent ball 5, under the force of the biasing member 4, snaps into the second engagement recess 3023. Second, the user feels the hard stop from the limit stop mechanism. At this point, the mechanical interference between the locking plate 303 and the protrusion member 301 is fully engaged, and the secondary dumbbell plate 202 is now a safe and integral part of the dumbbell apparatus, capable of bearing full load without any risk of separation.

B. Disassembling a Secondary Dumbbell Plate

To remove weight from the dumbbell, the user performs the reverse steps:

1. Initial Torque Application: The user grips the outermost secondary dumbbell plate 202 and applies a rotational force in the opposite direction of the locking motion. A small initial torque is required to overcome the retaining force of the detent mechanism, causing the detent ball 5 to pop out of the second engagement recess 3023. This intentional resistance prevents accidental unlocking.

2. Counter-Rotation: Once the detent is overcome, the plate rotates smoothly back toward the unlocked position, again guided by the fan-shaped surfaces 3012 and 3021. During this rotation, the mechanical interference between the locking plate 303 and the protrusion member 301 is disengaged.

3. Assisted Axial Separation: As the plate nears the final unlocked orientation, a portion of the protrusion member 301 may come into contact with the sloped surface 3024 within the first receiving recess 302. This interaction generates a gentle but effective axial camming force, which actively pushes the two plates apart. This feature ensures that the plates separate easily without sticking, even after heavy use.

4. Removal: Once the plate has returned to the initial alignment orientation, the mechanical lock is fully released, and the user can simply lift the secondary dumbbell plate 202 axially away from the dumbbell assembly.

VI. Alternative Embodiments and Variations

It is to be understood that the invention is not limited in its application to the details of construction and the arrangement of components set forth in the preceding description or illustrated in the drawings. The invention is capable of other embodiments and of being practiced or of being carried out in various ways. The following discussion presents a non-limiting range of potential variations.

A. Materials and Manufacturing

While specific materials have been suggested, a wide variety of materials could be used for the various components, chosen based on desired performance characteristics, cost, and aesthetics.

Handle and Connecting Rod: For ultra-premium applications, the handle 1 and connecting rod 102 could be machined from stainless steel (e.g., 304 or 316 grade) for maximum corrosion resistance, or even from titanium for a high strength-to-weight ratio. The cylindrical shell 101 could be coated using processes like chrome plating, black oxide finishing, or Cerakote for enhanced durability and appearance. The grip portion could feature an over-molding of thermoplastic urethane (TPU) or silicone for improved comfort.

Connection Assembly Components: For applications requiring extreme load-bearing capacity or durability (e.g., very heavy commercial dumbbells), the protrusion member 301 and/or the mounting plate 204 incorporating the locking plate 303 could be manufactured from metal, such as forged or CNC-machined aluminum or steel. In such cases, a low-friction coating like Teflon or a polymer insert could be used at the sliding interfaces to ensure smooth operation. High-performance engineering polymers such as PEEK (polyether ether ketone) or Delrin (acetal homopolymer) could also be employed for their excellent strength, dimensional stability, and low coefficient of friction.

Weight Plates: The outer casing 203 could be made from a soft, non-marring urethane, similar to high-end commercial fixed dumbbells. The weight core 205, while typically cast iron, could be made from precisely cut steel plates or a tungsten-polymer composite to achieve higher density and a slimmer plate profile.

Manufacturing Methods: The polymer components, such as the outer casing 203 and mounting plate 204, are ideally suited for high-volume manufacturing via injection molding. The metallic components, such as the handle 1 and weight core 205, could be manufactured via casting, forging, or machining processes.

B. Geometric and Structural Variations

The specific geometry of the connection assembly can be varied without departing from the inventive concept.

Number of Locking Lugs: The illustrated embodiment shows a two-lug locking design (implied by the S-shaped/yin-yang geometry of the locking plate 303). The number of locking lugs and corresponding recesses can be varied. For example, a three-lug or four-lug bayonet-style mount could be employed for potentially more even load distribution, albeit at the cost of increased manufacturing complexity. Conversely, a single-lug design is also within the scope of the invention.

Shape of Engagement Features: The overall footprint of the protrusion member 301 and first receiving recess 302 need not be circular. It could be triangular, square, or have a custom, non-symmetrical keyed shape to further enhance the ease of alignment.

Rotation Angle: The required angle of relative rotation to move from the unlocked to the locked position can be varied. While a rotation of 45-90 degrees is typical, the mechanism could be designed to lock with a shorter rotation (e.g., 30 degrees) for even faster operation, or a longer rotation (e.g., 120 degrees) for specific applications.

C. Functional Variations

The functional aspects of the mechanism can also be implemented in alternative ways.

Alternative Detent Mechanisms: The detent mechanism is not limited to the described ball-and-spring embodiment. An alternative could involve a cantilevered leaf spring with an integrated bump, molded directly into the polymer of the mounting plate 204. This leaf spring would deflect and then snap into a recess, creating the desired tactile and audible feedback while reducing part count. Another alternative could be a magnetic detent, where small, powerful rare-earth magnets are embedded in the protrusion member and the receiving recess, attracting each other to hold the assembly in the locked position.

Locking Indicator: To provide an additional layer of safety confirmation, a visual locking indicator could be incorporated. For example, a colored marker could be placed on the periphery of the secondary dumbbell plate, which aligns with a corresponding "LOCKED" symbol on the adjacent plate only when the rotation is complete.

D. Application to Other Equipment

The core inventive concept of the rotational connection assembly 3 is not limited in its application to dumbbells. This robust and rapid connection mechanism could be readily adapted for use in a wide range of other fitness and weight training equipment, including:

Adjustable Barbells: The same connection assembly could be used on the ends of a barbell to allow for the rapid addition and removal of larger weight plates.

Adjustable Kettlebells: A base handle could be equipped with the connection assembly to allow for the attachment of different weight pods underneath, creating a weight-adjustable kettlebell.

Machine Weight Stacks: The selector pin in a traditional weight stack machine could be replaced with this mechanism, allowing users to add smaller, incremental weight plates to the main stack for micro-loading.

VII. Advantages

The weight-adjustable dumbbell apparatus of the present disclosure offers numerous significant advantages over the prior art, providing a comprehensive solution that synthesizes speed, safety, and durability.

Unparalleled Speed: The "insert and twist" operation allows weight changes to be completed in a matter of seconds, rivaling or exceeding the speed of expensive and complex selectorized systems.

Uncompromising Safety: The breech-lock style mechanical interference of the connection assembly creates an exceptionally strong and reliable lock that is not prone to loosening under vibration. The integrated detent mechanism provides clear, unambiguous feedback, giving the user total confidence in the security of the locked plates.

Exceptional Durability: The design minimizes the number of small, complex moving parts, relying instead on large, solid load-bearing surfaces. This leads to a highly robust and durable apparatus with a greatly reduced risk of mechanical failure compared to selectorized systems.

Superior User Experience: The apparatus feels and behaves like a set of solid, fixed dumbbells. There is no rattling or play between the plates, and the smooth, guided rotation and positive "click" feedback make using the system a satisfying and confidence-inspiring experience.

Design Versatility: The core mechanism is highly adaptable and can be implemented in a variety of materials and form factors, and can be applied to other types of fitness equipment.

In conclusion, the present invention provides a significant leap forward in the field of adjustable free weights. By providing a connection assembly that is simultaneously rapid, robust, intuitive, and exceptionally secure, it solves the critical deficiencies of prior art systems. The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

What is claimed is:

1. A weight-adjustable dumbbell apparatus, comprising: a handle and two sets of dumbbell plates, each set of the two sets of dumbbell plates comprising a primary dumbbell plate and a plurality of secondary dumbbell plates, wherein each primary dumbbell plate is fixedly attached to a respective end of the handle; and at least two connection assemblies disposed between any two adjacent dumbbell plates of the two sets of dumbbell plates, wherein each of the connection assemblies comprises: a protrusion member extending from a first plate of the any two adjacent dumbbell plates; a first receiving recess formed in a second plate of the any two adjacent dumbbell plates; a locking plate disposed within the first receiving recess; and a first engagement recess disposed on the protrusion member; wherein the locking plate is configured to engage the first engagement recess upon a relative rotation between the first plate and the second plate of the any two adjacent dumbbell plates to prevent axial separation thereof, and wherein a surface area of the first receiving recess is greater than a surface area of the protrusion member; wherein each of the dumbbell plates comprises an outer casing, a mounting plate, and a weight core, wherein the outer casing is provided with an engagement block having a sloped surface, the mounting plate is provided with a corresponding third engagement recess, and wherein an edge of the mounting plate is provided with an auxiliary notch.

2. The weight-adjustable dumbbell apparatus of claim 1, wherein a sidewall of the first receiving recess is provided with a plurality of concentric first fan-shaped surfaces, wherein the protrusion member is provided with a plurality of concentric second fan-shaped surfaces, and wherein the first fan-shaped surfaces are configured to mate with the second fan-shaped surfaces.

3. The weight-adjustable dumbbell apparatus of claim 2, wherein the locking plate is provided with a limit stop portion, the first engagement recess is provided with a bearing portion, and wherein the limit stop portion is configured to be limited by the bearing portion.

4. The weight-adjustable dumbbell apparatus of claim 3, wherein the first receiving recess is provided with an arcuate recessed portion, the protrusion member is provided with an arcuate protruding portion, and wherein the arcuate recessed portion is configured to mate with the arcuate protruding portion.

5. The weight-adjustable dumbbell apparatus of claim 4, wherein a sloped surface is provided within the first receiving recess, and wherein one end of the protrusion member slides along the sloped surface when the first engagement recess disengages from the locking plate.

6. The weight-adjustable dumbbell apparatus of claim 1, wherein the locking plate is provided with a raised feature, the first engagement recess is provided with a corresponding indentation, and wherein the raised feature engages the indentation when the locking plate engages the first engagement recess.

7. The weight-adjustable dumbbell apparatus of claim 6, wherein a second receiving recess is formed in the protrusion member, a biasing member and a detent ball are disposed within the second receiving recess, wherein a portion of the detent ball protrudes from a surface of the second receiving recess, wherein a second engagement recess is formed in the first receiving recess corresponding to the detent ball, and wherein the locking plate engages the first engagement recess when the detent ball engages the second engagement recess.

8. The weight-adjustable dumbbell apparatus of claim 7, wherein the biasing member is a metallic coil spring.

9. The weight-adjustable dumbbell apparatus of claim 7, wherein the detent ball comprises one of stainless steel or ceramic.

10. The weight-adjustable dumbbell apparatus of claim 1, wherein the handle comprises a cylindrical shell and a connecting rod, wherein two sides of the cylindrical shell are connected to the outer casing of the primary dumbbell plate, and wherein the connecting rod passes through the outer casing of each of the two primary dumbbell plates and is threadedly connected to the weight core within each primary dumbbell plate.

11. The weight-adjustable dumbbell apparatus of claim 10, wherein an outer surface of the cylindrical shell is provided with a knurled texture to enhance grip.

12. The weight-adjustable dumbbell apparatus of claim 10, wherein the connection between the two sides of the cylindrical shell and the outer casing of the primary dumbbell plate is a permanent joint.

13. The weight-adjustable dumbbell apparatus of claim 10, wherein the threaded connection between the connecting rod and the weight core creates a pre-tensioned assembly.

14. The weight-adjustable dumbbell apparatus of claim 1, wherein the outer casing is manufactured from a polymer.

15. The weight-adjustable dumbbell apparatus of claim 14, wherein the outer casing has a polygonal shape providing an anti-roll feature.

16. The weight-adjustable dumbbell apparatus of claim 1, wherein the weight core comprises one of cast iron or steel.

17. The weight-adjustable dumbbell apparatus of claim 1, wherein at least one of the protrusion member or the mounting plate is manufactured from metal.

18. The weight-adjustable dumbbell apparatus of claim 1, further comprising a visual locking indicator configured to show a locked state when the relative rotation is complete.

19. The weight-adjustable dumbbell apparatus of claim 1, wherein the relative rotation between an unlocked position and the locked position is through an angle of between 30 and 120 degrees.

* * * * *